US010439343B2

(12) United States Patent
Sakal

(10) Patent No.: US 10,439,343 B2
(45) Date of Patent: Oct. 8, 2019

(54) POWER CORD ASSEMBLY FOR AN APPLIANCE

(71) Applicant: Haier US Appliance Solutions, Inc., Wilmington, DE (US)

(72) Inventor: Eric Ormsby Sakal, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/881,860

(22) Filed: Jan. 29, 2018

(65) Prior Publication Data

US 2019/0237923 A1 Aug. 1, 2019

(51) Int. Cl.

| | |
|---|---|
| ***H01R 31/06*** | (2006.01) |
| ***H01R 24/30*** | (2011.01) |
| *H01R 13/04* | (2006.01) |
| *H01R 29/00* | (2006.01) |
| *D06F 58/00* | (2006.01) |
| *H01R 103/00* | (2006.01) |

(52) U.S. Cl.

CPC ..... *H01R 31/06* (2013.01); *H01R 24/30* (2013.01); *D06F 58/00* (2013.01); *H01R 13/04* (2013.01); *H01R 29/00* (2013.01); *H01R 2103/00* (2013.01)

(58) Field of Classification Search

CPC ..... H01R 27/00; H01R 31/00; H01R 31/06; H01R 33/90; H01R 13/64; H01R 13/625

USPC ..... 439/218, 502, 337, 674

See application file for complete search history.

(56) References Cited

U.S. PATENT DOCUMENTS

| | | | | |
|---|---|---|---|---|
| 4,053,788 | A * | 10/1977 | Robie | G03G 15/80 307/11 |
| 4,386,333 | A * | 5/1983 | Dillan | H01F 29/00 336/107 |
| 4,900,270 | A * | 2/1990 | Edwards | H01R 31/06 439/173 |
| 6,200,155 | B1 | 3/2001 | Chudkosky et al. | |
| 6,536,333 | B2 | 3/2003 | Bouly et al. | |
| 8,197,265 | B1 * | 6/2012 | Lee | H01R 31/06 439/105 |
| 9,455,542 | B2 * | 9/2016 | Gaither | H01R 31/06 |
| 2012/0220148 | A1 * | 8/2012 | Walls, Jr. | H01R 31/06 439/218 |
| 2012/0220167 | A1 * | 8/2012 | Walls, Jr. | H01R 31/06 439/638 |

* cited by examiner

*Primary Examiner* — Hein D Vu

(74) *Attorney, Agent, or Firm* — Dority & Manning, P.A.

(57) ABSTRACT

An appliance and a power cord assembly for providing electrical power to the appliance are provided. A plug receptacle is positioned on the appliance cabinet which includes two hot prongs, a neutral prong, and a ground prong. A power cord extends between an appliance plug and a wall plug, the wall plug being coupled to either a three prong or four prong outlet. The appliance plug includes four terminals complementary to the plug receptacle, with the neutral terminal and the ground terminal being electrically coupled within the appliance plug if the power cord has three wires.

18 Claims, 6 Drawing Sheets

POWER CORD ASSEMBLY FOR AN APPLIANCE

FIELD OF THE INVENTION

The present subject matter relates generally to power cord assemblies for appliances, and more particularly to cord assemblies for high voltage appliances such as electric dryer and oven appliances.

BACKGROUND OF THE INVENTION

Certain conventional consumer appliances, such as electric dryers and oven ranges, operate at a higher voltage than typical 120V outlets. Specifically, such appliances typically operate off mains electricity at 240V. Notably, 240V outlets in older homes typically use a three wire electrical supply outlet including two hot wires and one neutral wire. By contrast, newer homes are typically required by government building codes and regulations (such as NFPA 70: National Electric Code) to have four wire electrical outlets to supply 240V.

Notably, to facilitate the use of such high voltage appliances in both old and new homes using both three wire and four wire electrical power cords, complicated wire installation procedures are typically required. Such installation procedures require additional tools, special installation skills, and complex wiring diagrams or instructions. In addition, the wiring procedures are time consuming and increase the risk of improperly connected wires, loose connections, and improper grounding.

Accordingly, improved power cord assemblies for high voltage appliances would be desirable. More particularly, power cord assemblies that simplify supplying power to a high voltage appliance having a four prong receptacle from either a three or four prong electrical outlet would be particularly beneficial

BRIEF DESCRIPTION OF THE INVENTION

The present subject matter provides an appliance and a power cord assembly for providing electrical power to the appliance. A plug receptacle is positioned on the appliance cabinet which includes two hot prongs, a neutral prong, and a ground prong. A power cord extends between an appliance plug and a wall plug, the wall plug being coupled to either a three prong or four prong outlet. The appliance plug includes four terminals complementary to the plug receptacle, with the neutral terminal and the ground terminal being electrically coupled within the appliance plug if the power cord has three wires. Aspects and advantages of the invention will be set forth in part in the following description, or may be obvious from the description, or may be learned through practice of the invention.

In one aspect of the present disclosure, an appliance is provided including a cabinet and a plug receptacle positioned on the cabinet, the plug receptacle including a first hot prong, a second hot prong, a neutral prong, and a ground prong, the plug receptacle being configured for receiving an appliance plug. A power cord extends between a wall plug and the appliance plug, the appliance plug including a first hot terminal, a second hot terminal, a neutral terminal, and a ground terminal, wherein the neutral terminal and the ground terminal are electrically coupled within the appliance plug if the power cord has three wires.

In another aspect of the present disclosure, a power cord assembly for an appliance is provided. The power cord assembly includes a plug receptacle positioned on the appliance, the plug receptacle including a first hot prong, a second hot prong, a neutral prong, and a ground prong, the plug receptacle being configured for receiving an appliance plug. A power cord extends between a wall plug and the appliance plug, the appliance plug including a first hot terminal, a second hot terminal, a neutral terminal, and a ground terminal, wherein the neutral terminal and the ground terminal are electrically coupled within the appliance plug if the power cord has three wires.

According to still another aspect of the present disclosure, a power cord for an appliance is provided. The appliance includes a cabinet and a plug receptacle including a first hot prong, a second hot prong, a neutral prong, and a ground prong. The power cord includes a wall plug having a first hot terminal, a second hot terminal, and a neutral terminal. An appliance plug is configured for receipt within the plug receptacle, the appliance plug including a first hot terminal, a second hot terminal, a neutral terminal, and a ground terminal, wherein the neutral terminal and the ground terminal are electrically coupled within the appliance plug. A wire assembly extends between the wall plug and the appliance plug, the wire assembly including a first hot wire, a second hot wire, and a neutral wire.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
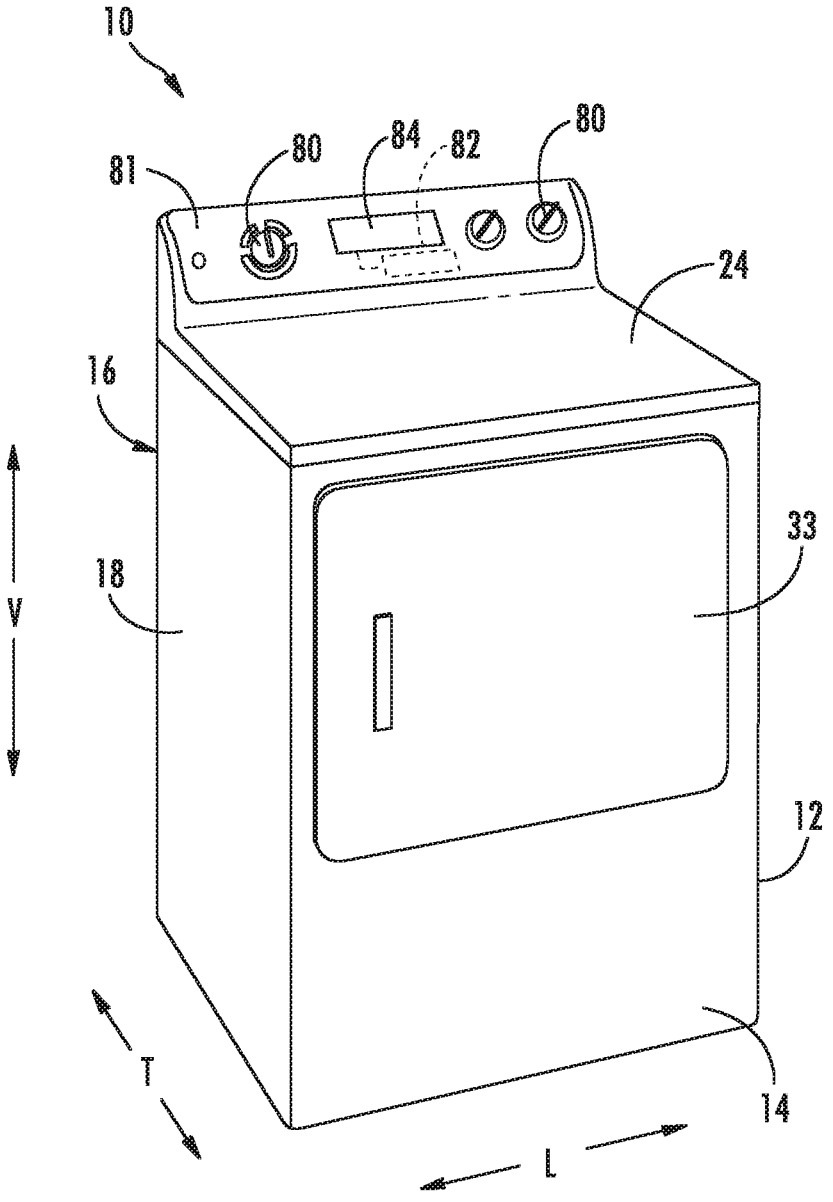
FIG. 1 provides a perspective view of a dryer appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
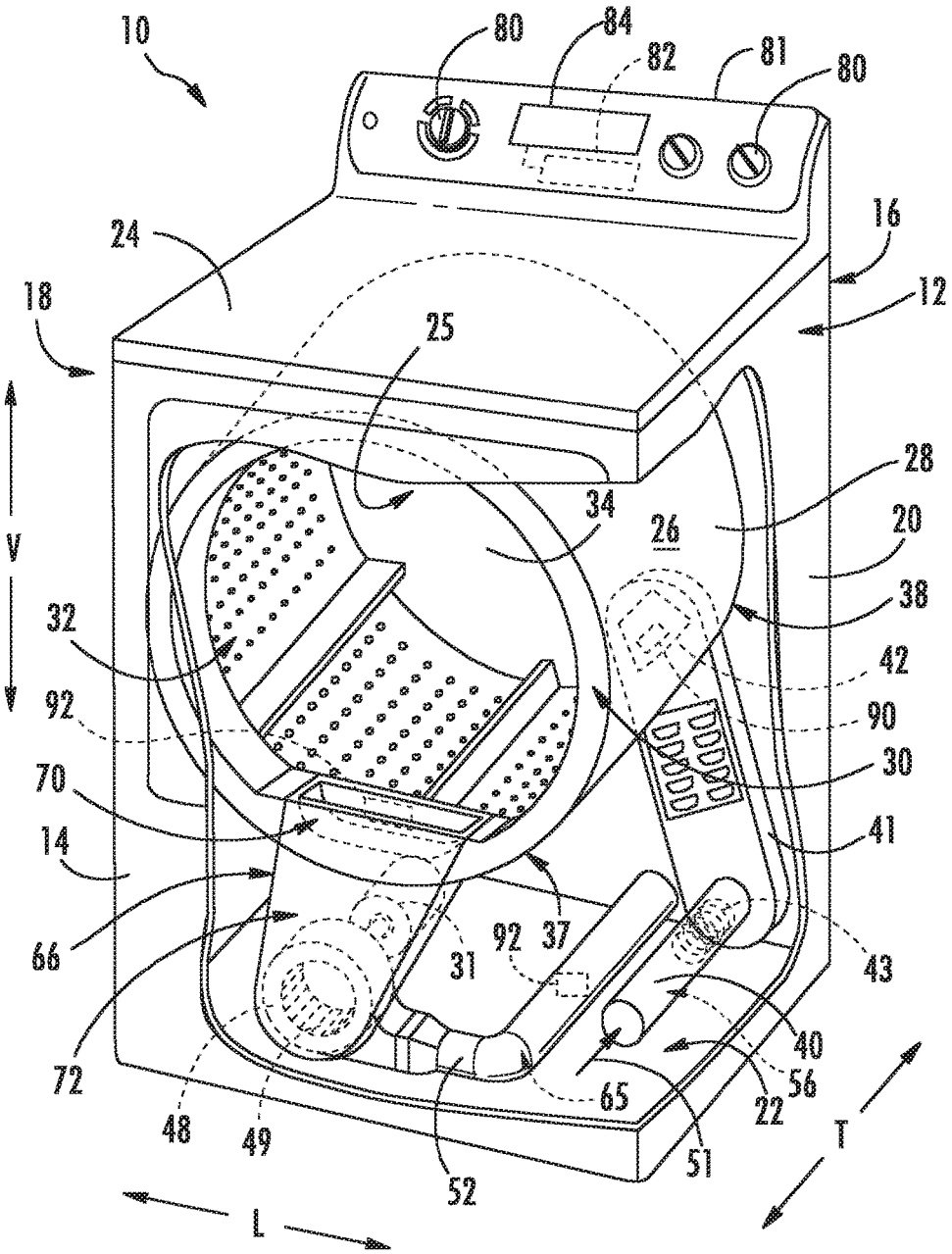
FIG. 2 provides a perspective view of the exemplary dryer appliance of FIG. 1 with portions of a cabinet of the exemplary dryer appliance removed to reveal certain components of the exemplary dryer appliance.

FIG. 1 illustrates a dryer appliance 10 according to an exemplary embodiment of the present subject matter. FIG. 2 provides another perspective view of dryer appliance 10 with a portion of a housing or cabinet 12 of dryer appliance 10 removed in order to show certain components of dryer appliance 10. While described in the context of a specific embodiment of a dryer appliance, using the teachings disclosed herein it will be understood that dryer appliance 10 is provided by way of example only. Other dryer appliances having different appearances and different features may also be utilized with the present subject matter as well. Moreover, aspects of the present subject matter may be used in any other suitable appliance, such as oven appliances.

Dryer appliance 10 defines a vertical direction V, a lateral direction L, and a transverse direction T. The vertical direction V, lateral direction L, and transverse direction T are mutually perpendicular and form an orthogonal direction system. Cabinet 12 includes a front panel 14, a rear panel 16, a pair of side panels 18 and 20 spaced apart from each other by front and rear panels 14 and 16, a bottom panel 22, and a top cover 24. Within cabinet 12 is a container or drum 26 which defines a chamber 25 for receipt of articles, e.g., clothing, linen, etc., for drying. Drum 26 extends between a front portion 37 and a back portion 38, e.g., along the transverse direction T. In example embodiments, drum 26 is rotatable, e.g., about an axis that is parallel to the transverse direction T, within cabinet 12.

Drum 26 is generally cylindrical in shape, having an outer cylindrical wall or cylinder 28 and a front flange or wall 30 that may define an entry 32 of drum 26, e.g., at front portion 37 of drum 26, for loading and unloading of articles into and out of chamber 25 of drum 26. Drum 26 also includes a back or rear wall 34, e.g., at back portion 38 of drum 26. Rear wall 34 of drum 26 may be fixed relative to cabinet 12, e.g., such that cylinder 28 of drum 26 rotates on rear wall 34 of drum 26 during operation of dryer appliance 10.

An air handler 48, such as a blower or fan, may be provided to motivate an airflow (not shown) through air passages 56, 65. Specifically, air handler 48 may include a motor 31 may be in mechanical communication with a blower fan 49, such that motor 31 rotates blower fan 49. Air handler 48 is configured for drawing air through chamber 25 of drum 26, e.g., in order to dry articles located therein, as discussed in greater detail below. In alternative example embodiments, dryer appliance 10 may include an additional motor (not shown) for rotating fan 49 of air handler 48 independently of drum 26.

Drum 26 may be configured to receive heated air that has been heated by a heating assembly 40, e.g., in order to dry damp articles disposed within chamber 25 of drum 26. Heating assembly 40 includes a heater 43 that is in thermal communication with drying chamber 25. For instance, heater 43 may include one or more electrical resistance heating elements or gas burners, for heating air being flowed to chamber 25. As discussed above, during operation of dryer appliance 10, motor 31 rotates fan 49 of air handler 48 such that air handler 48 draws air through chamber 25 of drum 26. In particular, ambient air enters an air entrance passage defined by heating assembly 40 via an entrance 51 due to air handler 48 urging such ambient air into entrance 51. Such ambient air is heated within heating assembly 40 and exits heating assembly 40 as heated air. Air handler 48 draws such heated air through an air entrance passage 56, including inlet duct 41, to drum 26. The heated air enters drum 26 through an outlet 42 of duct 41 positioned at rear wall 34 of drum 26.

Within chamber 25, the heated air can remove moisture, e.g., from damp articles disposed within chamber 25. This internal air flows in turn from chamber 25 through an outlet assembly positioned within cabinet 12. The outlet assembly generally defines an air exhaust passage 65 and includes a vent duct 66, air handler 48, and an exhaust conduit 52. Exhaust conduit 52 is in fluid communication with vent duct 66 via air handler 48. During a dry cycle, internal air flows from chamber 25 through vent duct 66 to air handler 48, e.g., as an outlet flow portion of airflow. As shown, air further flows through air handler 48 and to exhaust conduit 52. The internal air is exhausted from dryer appliance 10 via exhaust conduit 52.

In exemplary embodiments, vent duct 66 can include a filter portion 70 and an exhaust portion 72. Exhaust portion 72 may be positioned downstream of filter portion 70 (in the direction of airflow of the internal air). A screen filter of filter portion 70 (which may be removable) traps lint and other particulates as the internal air flows therethrough. The internal air may then flow through exhaust portion 72 and air handler 48 to exhaust conduit 52. After the clothing articles have been dried (or a drying cycle is otherwise completed), the clothing articles are removed from drum 26 via entry 32. A door 33 provides for closing or accessing drum 26 through entry 32.

One or more selector inputs 80, such as knobs, buttons, touchscreen interfaces, etc., may be provided on a cabinet backsplash 81 and in communication with a processing device or controller 82. Signals generated in controller 82 operate motor 31 and heating assembly 40, including heater 43, in response to the position of selector inputs 80. Additionally, a display 84, such as an indicator light or a screen, may be provided on cabinet backsplash 82. Display 84 may be in communication with controller 82, and may display information in response to signals from controller 82. As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations. For certain embodiments, the instructions include a software package configured to operate appliance 10 and execute certain cycles (e.g., a temperature-contingent dryer cycle).

In some embodiments, dryer appliance 10 also includes one or more sensors. For example, dryer appliance 10 may include an airflow sensor 90. Airflow sensor 90 is generally operable to detect the velocity of air (e.g., as an air flow rate in meters per second, or as a volumetric velocity in cubic meters per second) as it flows through the appliance 10. Generally, airflow sensor 90 is at least partially positioned within air passage 56 or 65 to detect airflow. In some embodiments, airflow sensor 90 is positioned within inlet duct 41, e.g., at or proximal to an inlet of drum 26. Additionally or alternatively, airflow sensor 90 may be positioned at another suitable location, such as within exhaust conduit 52, vent duct 66, and/or another portion of inlet duct 41. Airflow sensor 90 may be embodied by any suitable configuration, such as a Pitot tube or a set of dual static-pressure taps connected to a pressure transducer. When assembled, airflow sensor 90 may be in communication with (e.g., electrically coupled to) controller 82, and may transmit readings to controller 82 as required or desired.

Dryer appliance 10 may further include, for example, one or more temperature sensors 92. Temperature sensor 92 is generally operable to measure internal temperatures in dryer appliance 10. In some embodiments, temperature sensor 92 is disposed proximal to an outlet of drum 26 (e.g., within vent duct 66). In additional or alternative embodiments, a temperature sensor 92 is disposed along exhaust conduit 52, in thermal communication therewith. For example, temperature sensor 92 may extend at least partially within passage 65 to measure the temperature of air therethrough. In further additional or alternative embodiments, a temperature sensor 92 may be disposed at any other suitable location within dryer appliance 10 to detect the temperature of airflow (e.g., downstream from chamber 25). Temperature sensor 92 may be embodied as a thermistor, thermocouple, or any other suitable sensor for detecting a specific temperature value of air within appliance 10. When assembled, temperature sensor 92 may be in communication with (e.g., electrically coupled to) controller 82, and may transmit readings to controller 82 as required or desired.

In some embodiments, controller 82 is configured to vary operation of heating assembly 40 based on one or more temperatures detected at temperature sensor 92. For instance, controller 82 may automatically set or adjust one or more criteria for activation heating assembly 40 without an estimation of ambient conditions by a user. Specifically, controller 82 may determine an ambient temperature and set or adjust a threshold criterion accordingly. During use, controller 82 can initiate a temperature-contingent dryer cycle wherein a determination about the ambient conditions (e.g., ambient air temperature) is made, and operation of the appliance 10 is modified accordingly.

Referring now generally to FIGS. 3 through 6, a power supply system or power cord assembly 100 will be described according to an exemplary embodiment. Specifically, as described below, power cord assembly 100 is generally configured for supplying dryer appliance 10 with electrical power from a suitable electrical outlet, such as a 240V mains electricity outlet in a residential setting. Although power cord assembly 100 is described above as being configured for use with either a three-prong power cord or a four-prong power cord for supplying power to dryer appliance 10, it should be appreciated that according to alternative embodiments, aspects of power cord assembly 100 may be used to provide power from any suitable source to any suitable residential or commercial appliance, such as an electric oven.

Notably, power cord assembly 100 as described below may be advantageously used with high voltage appliances, such as electric dryers and oven appliances to simplify installation and providing a more secure power connection. As used herein, "high voltage" is intended to refer to voltages above standard household electrical outlets, i.e., above 120V. Specifically, high voltage may be used to refer to 240V outlets typically used in residential settings for providing power to dryer appliances and oven ranges. Notably, as described briefly above, older houses supplied 240V power to appliances using three electrical wires and plugs having three corresponding prongs, referred to herein as "three-prong" devices or configurations. By contrast, newer houses supply 240V power to appliances using four electrical wires (including an added ground wire) and plugs having four corresponding prongs, referred to herein as "four-prong" devices or configurations.

Notably, newer appliances are designed for use with four-prong power cords, i.e., they receive power using two hot wires (each at 120V out of phase with each other), one neutral wire, and one ground terminal. In order to facilitate use of such appliances with both old three-prong and newer four-prong power cords, these appliance often include complex wiring instructions. As explained above, wiring such power cords requires additional skills and tools and frequently results in dangerous conditions due to improper wiring and/or loose connections. Power cord assembly 100 as described herein provides a quick, easy, and safe manner for connecting high voltage appliances to 240V outlets having either three prongs or four prongs. Exemplary power cord assemblies 100 are described below for the purpose of explaining such connections, but are not intended to limit the scope of the present subject matter. Further, due to the similarities of the three-prong and the four-prong configurations, similar reference numerals will be used to describe features of each.

Power cord assembly 100 generally includes a plug receptacle 102 that is positioned on or mounted to the appliance being powered. In this regard, continuing the example from above, plug receptacle 102 may be mounted directly onto cabinet 12 of dryer appliance 10. In addition, power cord assembly 100 includes a power cord 104 that when installed extends generally between a wall outlet 106 and the plug receptacle 102 for transferring electrical power to dryer appliance 10.

More specifically, power cord 104 generally includes a wire bundle or wire assembly 110 that extends between a first end having a wall plug 112 mounted and electrically coupled to wire assembly 110 and a second end having an appliance plug 114 mounted and electrically coupled to wire assembly 110. When installed, wall plug 112 is inserted into and electrically coupled to wall outlet 106 and appliance plug 114 is electrically coupled to plug receptacle 102. As shown herein, plug receptacle 102 is illustrated as the male electrical connector and appliance plug 114 is illustrated as the female electrical connector. However, it should be appreciated that according to alternative embodiments, the male and female connections may be reversed or any other suitable electrical connections or terminals may be used.

Figure 3:
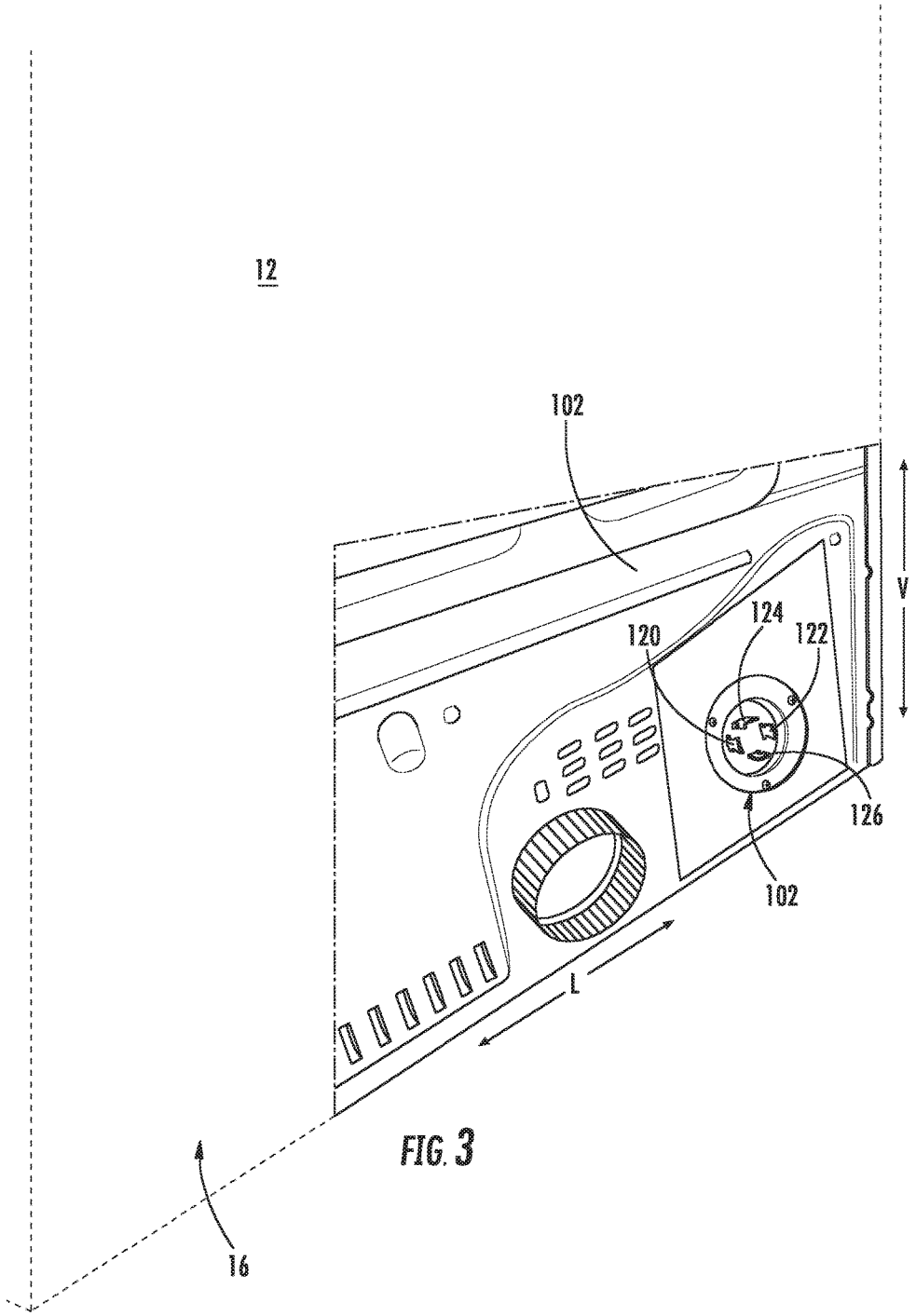
FIG. 3 provides a rear perspective view the exemplary dryer appliance of FIG. 1 including a plug receptacle according to an exemplary embodiment of the present subject matter.
Figure 5:
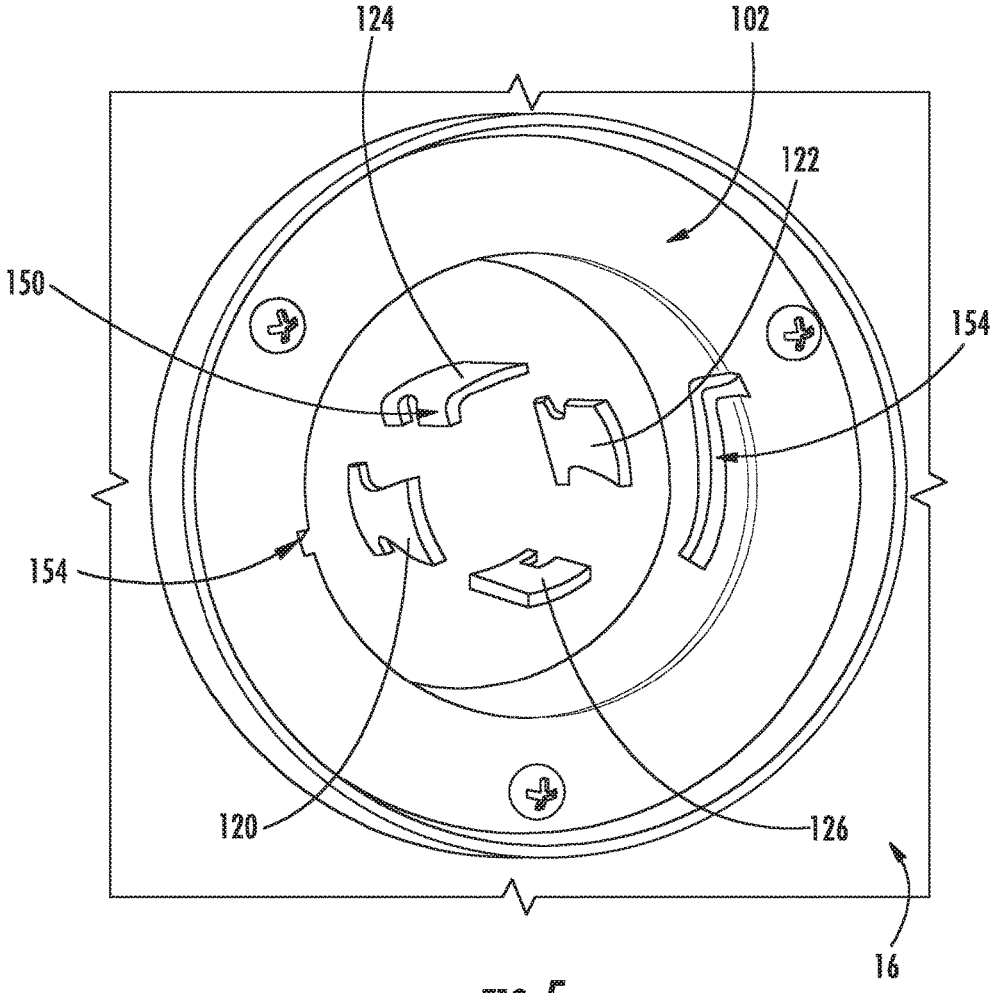
FIG. 5 provides a close-up perspective view of the exemplary plug receptacle of FIG. 3.

As best shown in FIGS. 3 and 5, plug receptacle 102 includes a first hot prong 120, a second hot prong 122, a neutral prong 124, and a ground prong 126. According to exemplary embodiments, dryer appliance generally operates on 240V, such that first hot prong 120 (or the associated terminal) has an electric potential of 120V relative to ground prong 126. Similarly, second hot terminal 122 has an electric potential of 120V relative to ground prong 126 and 240V relative to first hot prong 120.

Figure 4:
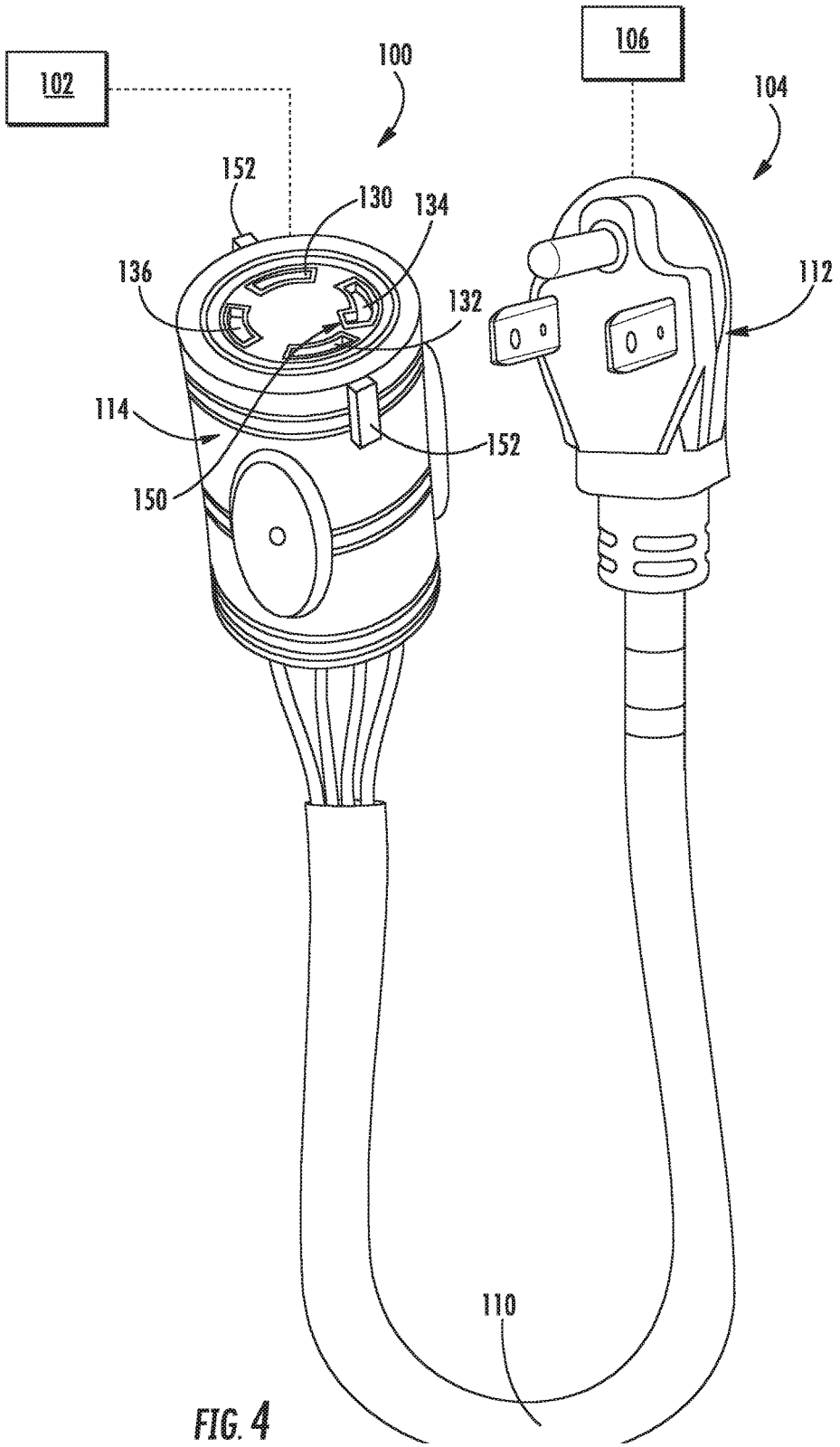
FIG. 4 provides a perspective view of an exemplary power cord assembly for use with the exemplary plug receptacle of FIG. 3 according to an exemplary embodiment of the present subject matter.

As best shown in FIG. 4, appliance plug 114 is a plastic housing positioned over the electrical terminations or terminals of wire assembly 110 on the appliance side. Appliance plug 114 may be safely and easily handled by an installer of the appliance without the risk of touching live prongs and may prevent inadvertent or incorrect installation. In general, appliance plug 114 includes a first hot terminal 130, a second hot terminal 132, a neutral terminal 134, and a ground terminal 136. Notably, terminals 130-136 are electrically coupled with prongs 120-126 when power cord assembly 100 is properly installed.

Figure 6:
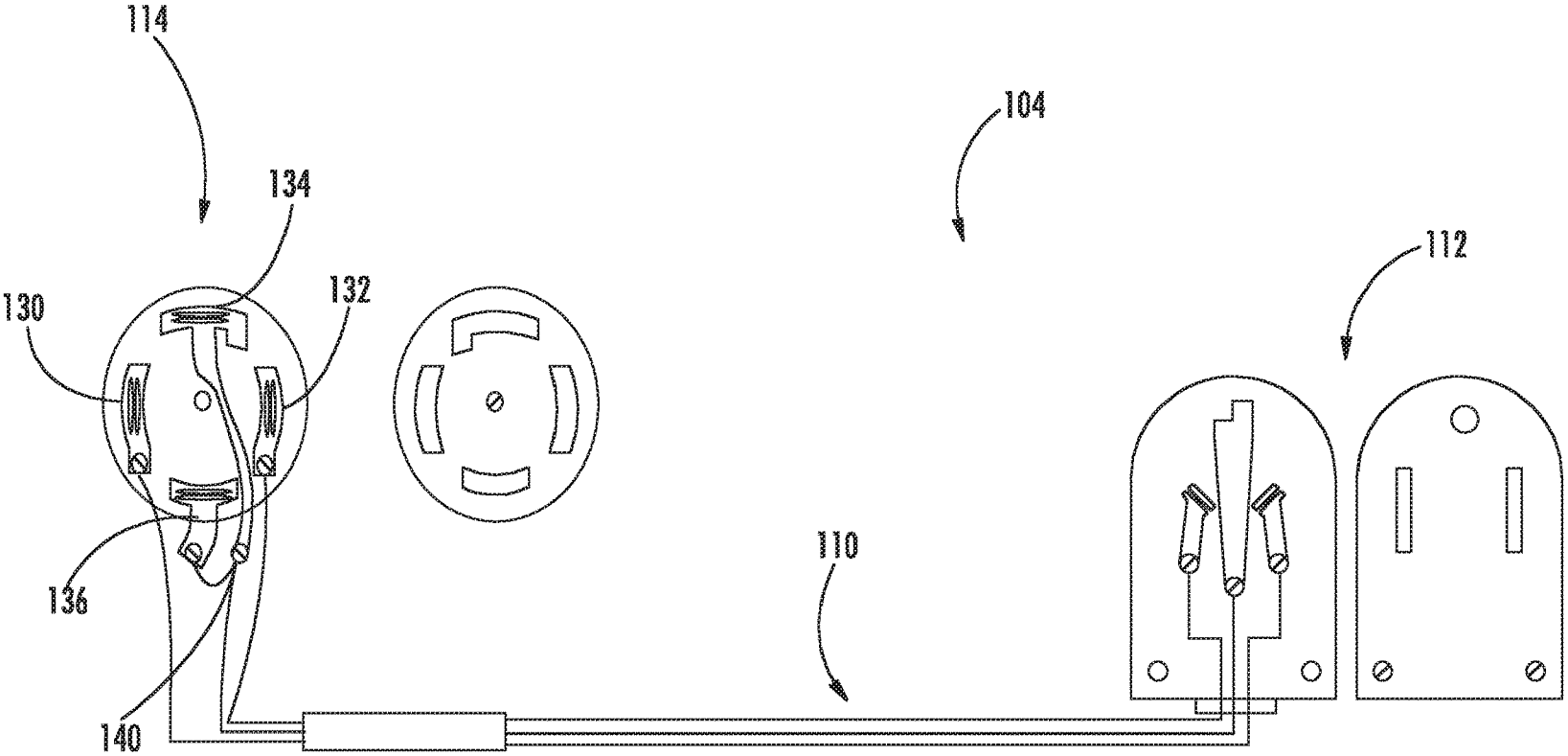
FIG. 6 provides an exemplary wiring diagram of a three wire power cord for use in the exemplary power cord assembly of FIG. 4 according an exemplary embodiment of the present subject matter.

However, because wire assembly 100 may include three wires (hot, hot, neutral) or four wires (hot, hot, neutral, ground), appliance plug 114 is configured for making important electrical connections depending on whether a three-prong plug or a four-prong plug is used. Specifically, as shown in FIG. 6 according to an exemplary embodiment, when a three-prong cord is used, neutral terminal 134 and ground terminal 136 are electrically coupled within appliance plug 114, e.g., via a jumper strap 140 or other suitable electrical connection. By contrast, if power cord 104 has four wires (a four-prong cord), neutral terminal 134 and ground terminal 136 are electrically decoupled and instead directly connected to the neutral wire and ground wire, respectively. Notably, such wiring permits and installer to pick either a three-prong or four-prong power cord assembly 100 depending on the type of wall outlet 106 present. The installer may then simply plug wall plug 112 into wall outlet 106 and appliance plug 114 onto plug receptacle to make all necessary electrical connections.

As explained above, plug receptacle 102 is generally configured for receiving appliance plug 114 to establish an electrical connection between power cord 104 and dryer appliance 10. In addition, power cord assembly 100 may define various other features for simplifying installation and electrical connection, as well as reducing the likelihood of accidental disconnection or strains on power cord assembly 100. For example, plug receptacle 102 may be recessed within cabinet 12. In this manner, when dryer appliance 10 is pushed back against the wall, appliance plug 114 and wire assembly 110 may not experience excessive stresses.

In addition, as illustrated, plug receptacle 102 and appliance plug 114 may defined features to prevent incorrect installation. For example, plug receptacle 102 and/or appliance plug 114 may define at least one keyed feature 150 for properly aligning appliance plug 114 on plug receptacle 102. In this regard, for example, one or more prongs of plug receptacle 102 may be L-shaped or have another suitable shape such that appliance plug 114 may only be installed onto plug receptacle 102 in the proper orientation. According to still other embodiments, first hot prong 120, second hot prong 122, neutral prong 124, and ground prong 126 may be pins or blades that extend from plug receptacle 102 and create a friction fit with certain terminals in appliance plug 114 or may interfere with insertion when incorrectly positioned or oriented.

Furthermore, appliance plug 114 may define a mating feature 152 and plug receptacle 102 may define a complementary feature 154 for receiving mating feature 152 of appliance plug 114. For example, as best illustrated in FIGS. 4 and 5, mating feature 152 may be one or more protrusions extending from appliance plug 114 and complementary feature 154 may be a recessed slot defined by plug receptacle 102. These features 152, 154 may generally act as a twist-and-lock feature to prevent inadvertent disconnection of power cord assembly 100. According to alternative embodiments, appliance plug 114 and plug receptacle 102 may define a threaded connection to create a secure connection for power cord assembly 100. Other securing means and methods of connecting power cord 104 are possible and within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance comprising:

a cabinet;

a plug receptacle positioned on the cabinet, the plug receptacle including a first hot prong, a second hot prong, a neutral prong, and a ground prong, the plug receptacle being configured for receiving an appliance plug; and a power cord that extends between a wall plug and the appliance plug, the appliance plug comprising a first hot terminal, a second hot terminal, a neutral terminal, and a ground terminal, wherein the neutral terminal and the ground terminal are electrically coupled by a jumper strap positioned within the appliance plug if the power cord has three wires;

wherein the neutral terminal and the ground terminal are electrically decoupled if the power cord has four wires.

2. The appliance of claim 1, wherein the plug receptacle and the appliance plug define at least one keyed feature for properly aligning the appliance plug on the plug receptacle.

3. The appliance of claim 1, wherein the first hot prong, the second hot prong, the neutral prong, and the ground prong are pins or blades that extend from the plug receptacle.

4. The appliance of claim 1, wherein the plug receptacle is recessed within the cabinet.

5. The appliance of claim 1, wherein the appliance plug defines a mating feature and the plug receptacle defines complementary feature for receiving the mating feature of the appliance plug.

6. The appliance of claim 1, wherein the first hot terminal and the second hot terminal each have an electric potential of 120V relative to the ground terminal and 240V relative to each other.

7. The appliance of claim 1, wherein the appliance is an electric dryer or an oven appliance.

8. A power cord assembly for an appliance, the power cord assembly comprising:

a plug receptacle positioned on the appliance, the plug receptacle including a first hot prong, a second hot prong, a neutral prong, and a ground prong, the plug receptacle being configured for receiving an appliance plug; and a power cord that extends between a wall plug and the appliance plug, the appliance plug comprising a first hot terminal, a second hot terminal, a neutral terminal, and a ground terminal, wherein the neutral terminal and the ground terminal are electrically coupled by a jumper st rap positioned within the appliance plug if the power cord has three wire, wherein the neutral terminal and the ground terminal are electrically decoupled if the power cord has four wires.

9. The power cord assembly of claim 8, wherein the plug receptacle and the appliance plug define at least one keyed feature for properly aligning the appliance plug on the plug receptacle.

10. The power cord assembly of claim 8, wherein the first hot prong, the second hot prong, the neutral prong, and the ground prong are pins or blades that extend from the plug receptacle.

11. The power cord assembly of claim 8, wherein the plug receptacle is recessed within a cabinet of the appliance.

12. The power cord assembly of claim 8, wherein the appliance plug defines a mating feature and the plug receptacle defines complementary feature for receiving the mating feature of the appliance plug.

13. The power cord assembly of claim 8, wherein the first hot terminal and the second hot terminal each have an electric potential of 120V relative to the ground terminal and 240V relative to each other.

14. The power cord assembly of claim 8, wherein the appliance is an electric dryer or an oven appliance.

15. A power cord for an appliance, the appliance comprising a cabinet and a plug receptacle including a first hot prong, a second hot prong, a neutral prong, and a ground prong, the power cord comprising:

a wall plug having a first hot terminal, a second hot terminal, and a neutral terminal;

an appliance plug configured for receipt within the plug receptacle, the appliance plug comprising a first hot terminal, a second hot terminal, a neutral terminal, and a ground terminal, wherein the neutral terminal and the ground terminal are electrically coupled by a jumper strap positioned within the appliance plug; and a wire assembly extending between the wall plug and the appliance plug, the wire assembly comprising a first hot wire, a second hot wire, and a neutral wire.

16. The power cord of claim 15, wherein the plug receptacle and the appliance plug define at least one keyed feature for properly aligning the appliance plug on the plug receptacle.

17. The power cord of claim 15, wherein the appliance plug defines a mating feature and the plug receptacle defines complementary feature for receiving the mating feature of the appliance plug.

18. The power cord of claim 15, wherein the first hot terminal and the second hot terminal each have an electric potential of 120V relative to the ground terminal and 240V relative to each other.

* * * * *